US005492468A

United States Patent [19]

Cirami

[11] Patent Number: 5,492,468

[45] Date of Patent: Feb. 20, 1996

[54] CHILD-RESISTANT LIGHTER WITH EXTERNALLY BIASED ACTUATOR

[76] Inventor: Salvatore Cirami, 12-21 35 Ave., Apt. 4F, Long Island City, N.Y. 11106

[21] Appl. No.: 351,530

[22] Filed: Dec. 7, 1994

Related U.S. Application Data

[63] Continuation-in-part of Ser. No. 217,751, Mar. 25, 1994, abandoned, Ser. No. 33,818, Mar. 22, 1993, abandoned, Ser. No. 942,629, Sep. 9, 1992, Pat. No. 5,242,297, and Ser. No. 780,245, Oct. 22, 1991, abandoned.

[51] Int. Cl.[6] ..... F23D 11/36

[52] U.S. Cl. ..... 431/153; 431/277

[58] Field of Search ..... 431/277, 276, 431/153, 344; 222/153

[56] References Cited

U.S. PATENT DOCUMENTS

| | | | |
|---|---|---|---|
| 4,832,596 | 5/1989 | Morris, Sr. | 431/153 |
| 5,125,829 | 6/1992 | McDonough et al. | 431/255 |
| 5,205,729 | 4/1993 | Iwahori | 431/153 |
| 5,240,408 | 8/1993 | Kenjiro et al. | 431/153 |
| 5,242,297 | 9/1993 | Cirami | 431/153 |
| 5,364,261 | 11/1994 | Huang | 431/277 X |
| 5,378,143 | 1/1995 | Ansquer | 431/277 X |

*Primary Examiner*—Carl D. Price

[57] ABSTRACT

A child-resistant lighter includes a pushbutton depressible toward an upper end portion of the lighter body to operate a normally closed valve to an open condition that releases a combustible gas for ignition by sparks produced by means operated when the pushbutton is depressed. Wall members spaced apart on the upper end portion define a slot at a rearward end of the upper end portion. A stop member slidable longitudinally on the upper end portion includes a blocking member that normally blocks depression of a lower surface of the pushbutton whereby it is normally locked. A neck portion of the stop member extending through the slot has a projecting end defining an actuator having resilient arm members having free ends slidably engaged with outboard surfaces of the wall members such that the arm members flex when the actuator is pushed inwardly toward the slot and a longitudinally-directed return bias is thereby imparted to the actuator. Pushing the actuator first inwardly and then upwardly moves the blocking member first longitudinally inwardly removed from the pushbutton's lower surface and then into a resiliently maintained frictional contact with an inner side of the pushbutton whereby the pushbutton is unlocked. Depression of the pushbutton depresses the blocking member and after release of the pushbutton the blocking member is returned under the pushbutton's lower surface by the return bias of the actuator.

22 Claims, 3 Drawing Sheets

CHILD-RESISTANT LIGHTER WITH EXTERNALLY BIASED ACTUATOR

RELATED APPLICATION DATA

This is a continuation-in-part of U.S. patent application Ser. No. 217,751, filed Mar. 25, 1994, abandoned; Ser. No. 033,818, filed Mar. 22, 1993, abandoned; Ser. No. 942,629, filed Sep. 9, 1992, issued Sep. 7, 1993 as U.S. Pat. No. 5,242,297; and Ser. No. 780,245, filed Oct. 20, 1991, abandoned; the subject matter of which is incorporated herein by reference. Benefit of earliest filing date is claimed for common subject matter.

BACKGROUND

1. Field of the Invention

This invention relates generally to a gas lighter having a main body portion that forms a closed compartment for containment of a combustible fluid under pressure, an upper end portion on which is mounted a normally closed valve means communicating with said compartment for release of said fluid in a gaseous state, and a pushbutton that is engaged with the valve means and is depressible for operation of the valve means to an open condition that releases said fluid in said gaseous state; more particularly, to such a lighter wherein the pushbutton is normally blocked against depression by means of a stop member that is slidably mounted on the lighter's upper end portion under the pushbutton so as to normally block depression of the pushbutton but which stop member can be moved to an unblocking position by thumb pressure applied to an actuator portion of such stop member that projects from a rearward end of the lighter's upper end portion; and specifically, to such an arrangement wherein a lower surface of the pushbutton normally stands upon a portion of the stop member that defines a blocking member, wherein the actuator is pushed first inwardly in order to slide a top surface of the blocking member to a position longitudinally removed from the pushbutton's lower surface, and then pushed upwardly in order to bring an outer side of such blocking member into a resiliently maintained frictional contact with an inner side of the pushbutton whereby the pushbutton is placed in an unlocked condition and the actuator can then be released and the thumb applied to the pushbutton for depression of it, and wherein, upon depression and release of the pushbutton the blocking member's top surface is returned to its initial position under the pushbutton's lower surface by the return bias of resilient arm members which form part of the actuator and which flex against outboard surfaces of the lighter's upper end portion in order to produce the return bias that is effective upon the blocking member.

For present purposes such a lighter shall be understood to have a longitudinal axis that extends across forward and rearward portions of the lighter's upper end portion, "so as to include and intersect said forward and rearward portions". The term "longitudinally" as used herein means in a direction parallel to said longitudinal axis, and the term "laterally" as used herein means cross-wise to such longitudinal axis.

A disposable lighter conventionally includes a main body portion defining a closed compartment that contains or is fillable with a combustible fluid under pressure, an upper end portion on which is mounted a normally closed valve means communicating with the fuel compartment for release of the fuel in a gaseous state, means defining a pushbutton that is connected with the valve means for operation of the valve means to an open condition the releases the combustible gas in response to depression of the pushbutton, and, means operable substantially simultaneously with depression of the pushbutton, producing a spark or sparks for ignition of the released gas to produce a flame.

The term "pushbutton" as used herein means that element which is pressed by thumb to operate the valve means to its gas-releasing open condition, and for present purposes it does not matter whether such pushbutton is formed by one end of a pivotally mounted lever or is a true pushbutton as in a piezo-electric lighter.

In all such lighters the pushbutton has a given normal elevation on the lighter's upper end portion and is depressible against the resistance of means biasing the pushbutton to return to its normal elevation. Conventionally, if the pushbutton is defined by the rearward end of a pivotally mounted lever the pushbutton-biasing means may be a spring that is incorporated in the valve means in order to bias the valve means normally closed but simultaneously also biasing the pushbutton by virtue of the engagement of a forward end of such lever with the valve means for operation of the valve means to its open condition by depression of the pushbutton. The prior art also provides such a pivotally mounted lever having a helical compression spring mounted directly under the pushbutton; i.e., between the pushbutton and the lighter's upper end portion. Recent prior art also provides a lighter having a pivotally mounted lever that has resilient legs formed integrally with an underside portion of the lever in an arrangement functioning as the pushbutton-biasing means. In the case of a piezo-electric lighter a spring incorporated in a compressible spark-generating device biases a pushbutton that is mounted at the upper end of such device.

The accompanying drawings illustrate a lighter wherein a lever extends longitudinally of the lighter's upper end portion and is pivotally mounted thereon between a pair of tab members which form part of the lighter's upper end portion. A rearward end of the lever defines a pushbutton and a forward end of the lever is engaged with a valve means that incorporates a spring that, as described above, biases the valve means normally closed, but there is also provided a helical compression spring mounted between the pushbutton and the lighter's upper end portion in order to directly bias the pushbutton to return to its normal elevation after depression and release.

Lighters in which a lever defines the pushbutton typically utilize an ignition means comprising a flintwheel that is rotatably mounted between the tab members overlying the lever, the flintwheel being rolled substantially simultaneously with depression of the pushbutton and abrading an underlying flint that generates sparks that ignite the released gas. The flint and an underlying flint-biasing spring that urges the flint into contact with an abrasive periphery of the flintwheel are mounted in and are supported by a flint-support column that rises from the lighter's upper end portion between the tab members, with an upper end of such column passing through a central opening in the lever in order to permit the flint to access the flintwheel. The said central opening in the lever defines what are herein termed "beam member portions" of the lever, reference being made to those portions of the lever intermediate its length which extend longitudinally of the lighter's upper end portion and are mounted between opposite sides of said flint-support column and the adjacent inboard sides of said tab members, the beam member portions conventionally being provided with lateral projections which are received in openings provided in the tab members whereby the lever is pivotally secured to the tab members for limited movement about a pivot axis. Conventionally, these beam member portions of the lever are mounted at an elevation on the tab members and as a result of such elevated mounting a free or open space conventionally exists between these beam member portions and the lighter's upper end portion on each side of the flint-support column. The present improvement preferably utilizes these spaces to receive the terminal ends of a pair of leg members which form the forward end of the stop member that makes the invention lighter child-resistant.

U.S. Pat. No. 5,242,297 referenced at the outset hereof under Related Application Data and not considered prior art, discloses a lighter wherein the pushbutton is normally blocked against depression by means of a stop member that is slidable longitudinally upon the lighter's upper end portion under a lower surface of the pushbutton, wherein the stop member includes an actuator portion thereof that projects from the rearward end of said upper end portion and is pushed first upwardly in order to unlock the actuator, and then pushed inwardly in order to move a blocking member of the stop member to a position longitudinally removed from a normal blocking position under said lower surface whereby a clearance adjacent the blocking member permits depression of the pushbutton, and wherein a forward end of the stop member remote from the actuator includes a pair of resilient arm members in the form of a U-shaped loop that is mounted within a recess provided in said upper end portion, the U-shaped loop being so arranged that the actuator is pushed inwardly against the resistance of said resilient arm members which then impart a longitudinally-directed return bias to the actuator and to the blocking member whereby the pushbutton is automatically returned to its normally locked condition. This arrangement has been found to be limited because of the inboard location of the resilient arm members which return bias the actuator and the blocking member. Where the stop member is a plastic molding in which the resilient arm member have thick cross-sections for ruggedness and as a result are relatively bulky, such inboard location of the resilient arm members reduces the space available for movement of the blocking member from its normal blocking position to its unblocking position under the pushbutton's lower surface. It is desired to provide an arrangement wherein the actuator must be pushed inwardly a substantial distance in order to move the blocking member from its blocking to its unblocking position, so that such operation of the actuator must be done deliberately and a child is not likely to do it by accident.

Major producers currently market child-resistant lighters having a rearwardly-located actuator that must be pushed first inwardly and then upwardly in order to unlock the pushbutton and so consumers have become conditioned to accept and have found convenient such mode of operation of the safety feature. Accordingly, it is desired to provide a child-resistant lighter having a similar first inward and then upward mode of operation of the actuator, but in combination with the child-resistancy enhancing advantage of requiring a substantial inward movement of the actuator in order to effect a corresponding substantial longitudinal movement of the blocking member from its pushbutton blocking to its pushbutton unblocking position. The present improvement attains this additional safety feature by forming the resilient arm members as part of the actuator itself so that the resilient arm members are mounted externally of the lighter body and as a result there is a sufficient free space inboard of the lighter body for the blocking member to be moved longitudinally the desired substantial distance in response to a corresponding substantial inward movement of the actuator.

The prior arrangement was further limited in that because the U-shaped resilient arm members are formed dependent from the blocking member portion of the stop member (for mounting in the recess), the stop member has a complex shape requiring a complex mold design. It is desired to provide an arrangement attaining the features described above by means of a stop member that is in the form of a substantially flat one-piece plastic member having a thick cross-section and the simplest possible shape so that such stop member is easy to mold using a die of least costly design, that is easy for a machine to handle and install in the lighter, and which, due to the ruggedness flowing from such proportions and shape will be absolutely reliable in operation and will not be dependent for such reliability upon maintenance of close manufacturing tolerances.

The present improvement provides an arrangement wherein the lighter's upper end portion is provided with a pair of wall members that define a single narrow slot at the rearward end of the lighter. An inboard portion of the stop member is mounted between laterally spaced apart inboard surfaces of such wall members. A neck portion of the stop member extends through and projects rearwardly of the slot and defines an actuator that includes a pair of resilient arm members which are spaced apart from but have free ends which are slidably engaged with outboard surfaces of the wall members, such that, when the actuator is pushed inwardly toward the slot (guided by said neck portion sliding within the slot), the free ends of the resilient arm members are forced to flex so as to impart a longitudinally-directed return bias to the actuator and thereby to the stop member as a whole. A lower surface of the pushbutton normally stands upon the top surface of a blocking member portion of the stop member whereby the pushbutton is normally blocked against depression. When the actuator is pushed inwardly, the blocking member is moved to a position longitudinally removed from the said pushbutton lower surface and a clearance is thereby produced adjacent to such blocking member that permits depression of the pushbutton for operation of the valve means to its gas-releasing open condition. However, the blocking member must be held in such longitudinally moved position. By pushing the actuator upwardly-while still holding it pushed inwardly--an outer side of the blocking member is lifted to a position longitudinally opposed to and in frictional contact with an inner side of the pushbutton. The actuator can then be released because the said frictional contact will hold the blocking member in its inwardly and upwardly moved position. The pushbutton is thereby caused to remain in an unlocked and depressible condition, the pushbutton being then depressible because the clearance mentioned above will then be under the blocking member portion of the stop member. Depression of the pushbutton pushes the blocking member back down to its normal elevation, and when the pushbutton is released, the return bias of the resilient arm members pulls the blocking member back under the pushbutton's lower surface whereby the pushbutton is automatically returned to its normally locked condition.

2. Description of Prior Art

Morris, Sr., U.S. Pat. No. 4,832,596 discloses a child-resistant lighter wherein a stop member is biased by spring means mounted externally of the lighter body, but having an actuator that is mounted at the forward end of the lighter body and has to be pulled inwardly with one's index finger, against the resistance of a coil spring or rubber pad that is mounted between the actuator and the forward end of lighter body, in order to hold the stop member in an unblocking position out from under the pushbutton while as the same time using one's thumb to depress the pushbutton. This arrangement is severely limited because of the forward location of the actuator which requires and awkward performance of two manipulations which are extremely difficult to do simultaneously.

Iwahori, U.S. Pat. No. 5,205,729 discloses a child-resistant lighter having wall members defining a single slot at the rearward end of the lighter's upper end portion and a stop member that includes a neck portion that is restricted to sliding longitudinally in the slot and defines the actuator portion of the stop member, but having a pair of resilient arm members mounted inboard of the wall members, and the pushbutton being unlocked merely by pushing the actuator inwardly toward the slot, a blocking member of the stop member being held at its inwardly moved unblocking position by means of an "action member" which is an integral part of the lighter's upper end portion and defines a resiliently depressible hook that functions to hook the stop member so as to hold it at its inwardly moved position until the pushbutton is depressed whereby the action member is pushed downwardly out of engagement with the stop member. Among other limitations, including unnecessary complexity, Iwahori's arrangement provides the minimum level of child-resistancy because the pushbutton is unlocked by pushing the actuator in only one direction; no other movement of it is required.

The present arrangement provides a higher level of child-resistancy because the actuator has to be pushed in two distinctly different directions and has the further advantage that, because the present actuator's return biasing means is located externally of the lighter body, the inboard portion of the stop member is free to be utilized as a means of positively stabilizing movement of the actuator; specifically, by defining a pair of rigid straight leg members which are spaced apart parallel to each other so that they can slide longitudinally under the beam member portions of the lighter's pushbutton-defining lever whereby longitudinal movement of the actuator is stabilized, with terminal ends of the leg members preferably being confined such that they define a secured fulcrum for the actuator that causes the actuator to pivot when pushed upwardly by thumb pressure and when pushed downwardly by depression of the pushbutton, this secured pivoting action of the actuator positively stabilizing such up and down movement of the actuator.

The present arrangement provides optimum child-resistancy by necessarily requiring the actuator to be moved in two distinctly different directions, and this added safety factor is attained by structure so arranged that one cannot unlock the pushbutton merely by pushing the actuator with a greater force in one direction or the other, or by applying such force on a vector that pushes the actuator in both directions at once. Accordingly, the possibility that an experimenting child will place the pushbutton in an unlocked condition is held to a reasonably attainable minimum.

The present arrangement provides optimum left-handed and right-handed user convenience by providing the actuator located at the rearward end of the lighter body, the actuator being pushed first inwardly a substantial distance in order to unblock the pushbutton, and then upwardly, in order to hold the pushbutton in its unblocked condition. The user is provided with a sure grip and comfortable feel for pushing the actuator upwardly by virtue of the actuator extending laterally across the rearward end of the lighter body and having slim proportions and an arcuate shape substantially conforming to the typical curvature of the lighter body whereby the actuator is comfortably received by one's thumb.

Kenjiro, et al., U.S. Pat. No. 5,240,408 (hereinafter abbreviated to "'408") provides an actuator having such desirable shape but in an arrangement having a significant functional limitation, identified below, which the present arrangement avoids.

In '408 a pair of wall members rise from the rearward portion of the lighter's upper end portion, as in the present improvement, but instead of a single narrow slot being defined by these wall members at the rearward end of the lighter's upper end portion (as in the present arrangement)in '408 the wall members are provided with a pair of slits which between them define a "resilient leaf" that has a lower end contiguous with the lighter's upper end portion and has an upper end that is curved inwardly toward the lighter's pushbutton. The inwardly curved upper end of the resilient leaf is normally received in a "recess" formed in the underside of the pushbutton, whereby the pushbutton is normally blocked against depression. Accordingly, '408 does not utilize a distinct stop member that is slidable longitudinally on its upper end portion.

In order to unlock the pushbutton so that it can be depressed, the upper end of the resilient leaf must be caused to move outwardly away from the pushbutton so as to be removed from the recess and thereby provide a clearance for depression of the pushbutton. This is accomplished by means of a "lock lever" that is mounted on and is slidable up and down upon the resilient leaf. The lock lever is normally positioned at the lower end of the resilient leaf. When the lock lever is pushed to the upper end of the resilient leaf, it does not follow the inward curvature of the resilient leaf but instead travels a straight path defined by edges of the wall members which edges stand adjacent to the resilient leaf, and as a result, the lock lever forces the upper end of the resilient leaf to flex outwardly away from the pushbutton and out of engagement with the recess. This arrangement is inherently incapable of providing the substantial inward movement of the actuator that is provided by the present improvement. The limited inward movability of the actuator of '408 adversely impacts the level of child-resistancy that is provided. It has been found by examination of marketed specimens of such lighter that the pushbutton can be unlocked and caused to remain in its unlocked condition merely by pushing the actuator in only a single direction, upwardly, with greater force, or, by pushing the actuator on a vector that causes the actuator to move both inwardly and upwardly simultaneously. The following discusses the cause of this limitation.

The lock lever of '408 comprises a basically rectangular annular member that forms a closed loop encircling the resilient leaf; such that, the longer sides of the rectangle are positioned one inboard and one outboard of the resilient leaf. The longer side of the rectangle that is positioned outboard of the resilient leaf defines an actuator portion of the lock lever. This actuator portion extends laterally across and slightly beyond adjacent sides of the resilient leaf and it has the above preferred laterally slim arcuate shape substantially corresponding to the curvature of the lighter body. The shorter sides of the rectangle are normally parallel to each other, extend through the slits, and, of course, join the inboard side of the lock lever with the outboard or actuator side of the lock lever.

Extremities of the actuator define "deformable legs" which hook onto and ride upon the above mentioned wall member edges which stand adjacent to the resilient leaf. The function of the "deformable legs" of '408 is demonstrable by cutting them off the lock lever and observing what function is lost. In the absence of the deformable legs the lock lever of '408 hangs loosely upon the resilient leaf and looses its ability to force the upper end of the resilient leaf out of engagement with the recess. The pushbutton remains permanently locked and there is no way to unlock it. Accordingly, the function of the deformable legs is to provide the lock lever with leverage, which the deformable legs obtain against the wall member edges which stand adjacent to the resilient leaf. The deformable legs ride upon these edges when the lock lever is pushed upwardly and thereby guide the lock lever as well as provide leverage for it to push the resilient leaf out of the recess. The deformable legs are so termed because a sufficient inwardly-directed thumb pressure applied to the actuator will force an outward deformation of the deformable legs by means of which "engaging elements" which are provided on the inboard portion of the lock lever and are normally engaged with the resilient leaf so as to normally prevent upward movement of the lock lever are caused to become disengaged from the resilient leaf so that the lock lever can then be pushed upwardly. But since longitudinal movement by deformation is inherently slight (as opposed to significant longitudinal movement enabled by resilient arm members), the engaging elements do not reliably serve their intended purpose and it is frequently possible to push the actuator directly upwardly without having to first push it inwardly, the upward push alone forcing the engaging elements out of their normal engagement with the resilient leaf.

In '408 the actuator is in the form of a cross-bar that has its opposite ends fixed to and supported by the spaced apart pair of members (the shorter sides of the rectangle) that project through the slits. Accordingly, Inwardly-directed thumb pressure applied to the actuator forces inward deformation of only that central portion of the actuator that extends between the said pair of members that extend through the slits, such inward pressure simultaneously forcing outward flexure of the deformable legs whereby the inward movement of the actuator is enabled, the deformable legs remaining longitudinally stationary upon the supporting edges of the wall members in order to provide leverage for compression of such central portion of the actuator. This arrangement produces only a slight longitudinal movement of the engaging elements for effecting their disengagement from the resilient leaf. Since the engaging elements must be releasable from the resilient leaf by such a slight longitudinal movement of them, the intended safety feature is not fail-safe but is subject to defeat by flexure of the engaging elements out of the recesses which are provided in the resilient leaf in which recesses the engaging elements are normally received, a certain amount of flexure of the engaging elements being unavoidable because the material from which the lock lever is made must be resilient in order for the central portion of the actuator to be compressible and the deformable legs to be deformable.

In the present arrangement the central portion of the actuator is not flexible (as in '408) but is instead fixed to and rigidly supported by the neck portion of the stop member, the ends of the actuator being free and resiliently flexible. This arrangement permits substantial longitudinal movement of the blocking member whereby it can be provided with a relatively broad top surface, and as a result, only a substantial longitudinal movement of the blocking member will remove it from its normal blocking position under the pushbutton's lower surface, and any flexibility inherent in the material from which the blocking member is made cannot adversely affect child-resistancy. No matter how hard one pushes the actuator upwardly the pushbutton will remain locked until the user first pushes the actuator inwardly far enough and then pushes it upwardly.

The accompanying drawings illustrate a preferred embodiment wherein the stop member is a substantially planar one-piece member having (a) an inboard portion mounted between wall members which are formed on and define a slot at the rearward end of the lighter's upper end portion, (b) a neck portion that extends through and projects rearwardly of said slot, (c) an actuator portion that is formed like a cross-bar that has its midpoint fixed to the projecting end of said neck portion and has an arcuate shape defining a pair of resilient arm members which originate from the neck portion of the stop member and have free ends slidably engaged with outboard surfaces of said wall members, (d) a pair of rigid leg members which are spaced apart parallel to each other and extend from the inboard portion of the stop member in a direction opposite from where the actuator is located, and (e) a blocking member formed near the neck portion having a top surface that normally underlies a cooperating lower surface of the pushbutton so as to normally block its depression.

FIGS. 4 and 5 of McDonough et al., U.S. Pat. No. 5,125,829 (hereinafter referred to as "'829") show a stop member at first glance resembling that described above but in fact differing significantly both structurally and functionally as follows. To facilitate comparison, terms which are employed herein to describe aspects of the invention stop member are applied to the corresponding structure of '829 unless otherwise indicated by placement within quotation marks.

First, and most significantly because the shape and function of all portions of the stop member of '829 are determined by this essential underlying difference, the stop member of '829, indicated generally in the drawings thereof as (16), is not slidable longitudinally upon the lighter's upper end portion. It has an actuator portion (54) that is structured for movement first "in a lateral direction" and then upwardly in order to position a neck portion (44) in frictional contact with either one of two laterally opposite sides (40) or (42) of a dependent portion of the lighter's pushbutton. This lateral movability of the actuator (54)is shown in FIGS. 9–12 of '829, wherein the numeral (16)indicates the stop member generally and the specification thereof identifies same as "safety latch 16".

In order to permit the lateral movability depicted in FIGS. 9–12 of '829, the lighter body has to define a slot (25), FIGS. 1 and 2, that permits lateral movability of the actuator (54) alternately in opposite directions relative to a normally centered position of the actuator (54)in the slot (25). This contrasts with the present arrangement wherein the lighter body has a slot that prevents lateral movability of the actuator.

In '829 the actuator (54) has a laterally-directed return bias that returns the actuator (54) to its normally centered position in slot (25). This contrasts with the present arrangement wherein the actuator has a longitudinally-directed return bias.

In '829 the laterally-directed actuator-biasing means is mounted inboard of the lighter body. This contrasts with the present arrangement wherein the actuator-biasing means is mounted outboard of the lighter body.

In '829 the laterally-directed actuator-biasing means comprises a C-shaped open loop that is contiguous at a midpoint thereof with the neck portion (44) and has diverging extensions of such loop defining a pair of resiliently flexible leg members (50, 52). This contrasts with the present arrangement which has a pair of rigid leg members which are wholly straight and spaced apart parallel to each other in order to be slidable longitudinally between the flint-support column and the tab members which support a pivotally mounted lever that defines the lighter's pushbutton.

In '829 the actuator (54)is wholly rigid, has no portion that is flexible, has its free ends always spaced apart from the lighter body, and functions solely as a gripping means for actuation and not as a return-biasing means. This contrasts with the present arrangement wherein the actuator defines a pair of resilient arm members which have free ends that are always engaged with and are resiliently flexible against outboard surfaces of the lighter body in order to function as a return-biasing means.

In '829 the neck portion (44) simultaneously defines a blocking member (44) of the stop member. A pushbutton lower surface (48) normally stands upon a top surface (46) of the neck or blocking member (44) whereby the pushbutton (34) is normally blocked against depression. In order to unlock the pushbutton (34), the actuator (54) is pushed first laterally one way or the other relative to the pushbutton's lower surface (48), and then upwardly. This contrasts with the present arrangement wherein the actuator is first pushed inwardly; i.e., longitudinally, before being pushed upwardly. In '829 the initial lateral movement brings the blocking member's top surface (46)into a position laterally removed from the pushbutton's lower surface (48). This contrasts with the present arrangement wherein the blocking member is moved into a position longitudinally removed from the pushbutton's lower surface. In '829, while holding the blocking member's top surface (46)in its laterally removed position from the pushbutton's lower surface (48), the actuator (54)is then pushed upwardly in order to bring one of two laterally opposite sides of the blocking member (44)into a laterally opposed frictional contact with a cooperating lateral side (40) or (42) of the pushbutton (34). This contrasts with the present arrangement wherein longitudinally opposed sides of the blocking member and pushbutton are brought into a longitudinally opposed frictional contact.

In '829, the laterally opposed frictional contact is resiliently maintained by flexure of the internally located resilient leg members (50, 52) which define a forward end of the stop member and function to impart a laterally-directed return bias to the blocking member (44). This contrasts with the present arrangement wherein the longitudinally opposed frictional contact is resiliently maintained by flexure of externally located resilient arm members which impart a longitudinally-directed return bias to the blocking member, and wherein the forward end of the stop member defines a pair of rigid leg members which function solely to stabilize movement of the actuator.

Finally, a child-resistant lighter currently marketed by a major producer has a pivotally mounted lever mounted on an upper end portion of the lighter body. A rearward end of such lever defines a pushbutton. The pushbutton is depressible against the resistance of a helical compression spring that is mounted directly under the pushbutton and biases the pushbutton to return to a given normal elevation on the lighter's upper end portion. A combination pushbutton blocking member and actuator has the actuator portion thereof projecting rearwardly of the lighter's upper end portion through a single slot that is provided in the rearward end of the lighter's upper end portion. A distinct element comprising a metal leaf spring is mounted inboard of the lighter's upper end portion. The leaf spring comprises a single arm that is positioned vertically, has its lower end fixed to the lighter body and has its upper end resiliently flexible in only a single direction, said direction being longitudinally of the lighter's upper end portion as the term "longitudinally" has been defined herein. The actuator/blocking member is mounted on the upper end portion of said leaf spring so as to be slidable up and down upon same. An upper end of the actuator/blocking member normally underlies and blocks depression of a lower surface of the pushbutton. The normally locked pushbutton is unlocked by pushing the actuator/blocking member first inwardly toward the slot, and then upwardly toward the pushbutton. The inward movement is enabled by flexure of the leaf spring, the resistance of which imparts a longitudinally-directed return bias to the actuator/blocking member. The upward movement is enabled by the vertical slidability of the actuator/blocking member upon the leaf spring. Said upward movement brings an outer side of the actuator/blocking member into a position longitudinally opposed to and in frictional engagement with an inner side of the pushbutton whereby a clearance is produced under the pushbutton's lower surface that renders the pushbutton depressible, the said frictional engagement being resiliently maintained by the return bias of the leaf spring acting upon the actuator/blocking member. Depression of the pushbutton pushes the actuator/blocking member back down to its initial elevation on the leaf spring, and when the pushbutton is released and returns to its normal elevation, the actuator/blocking member is returned to its initial position under the said lower surface of the pushbutton by the return bias of the leaf spring, whereby the pushbutton is automatically returned to its normally locked condition. That portion of the leaf spring upon which the actuator/blocking member is mounted is bent to define bumps that function to impede up and down slidability of the actuator/blocking member upon the leaf spring, such impedance being slight and not noticeable to the user of the lighter but being sufficient to ensure that the actuator/blocking member remains in its depressed position and does not follow the pushbutton when the pushbutton is depressed and then released.

The above described arrangement of the safety feature is limited by unnecessary complexity—it necessarily has to comprise two parts so that one part can be movable relative to the other. A further limitation is that the portion of the actuator/blocking member that defines the actuator per se is in the shape of a rectangular button that is positioned vertically and such shape is not easy for the user's thumb to obtain a grip on for pushing upwardly. A further limitation is that the leaf spring comprises a strip of metal having a loop formed at it lower end which must be forcibly pressed into a recess provided in the upper end portion of the lighter, a mode of installation which requires precision handling by machine and, due to the narrow width and thinness of such strip of metal, the possibility of its bending when being pressed into the recess. And finally, because it is necessary to provide a recess for holding the lower end of the spring, structure must be added to the main body portion of the lighter for defining said recess, and said added structure necessitates a slight reduction of the volume of the fuel compartment.

These limitations contrast with the present arrangement wherein the stop member comprises a single element, the actuator portion of such stop member extends laterally across the rearward end of the lighter and therefore inherently has a shape that is easy to push upwardly by thumb, the stop member is a relatively large element so that it is easy to handle by machine and is rugged because of its "chunky" design whereby it is not likely to break or deform, it does not require a high degree of precision in handling for installation, and since it is mounted wholly upon the upper end portion of the lighter body it has no effect upon the capacity of the fuel compartment.

The above has discussed all that prior art which is believed to most closely approach the present improvement and no more pertinent prior art is presently known.

SUMMARY OF THE INVENTION

A child-resistant lighter is provided that includes a pushbutton that is mounted on and is depressible toward an upper end portion of the lighter in order to operate a normally closed valve means to an open condition that releases a combustible gas from a fuel reservoir in a main body portion of the lighter, and is understood to have a longitudinal axis that extends between forward and rearward portions of the lighter's upper end portion.

An object of the invention is to provide a child-resistant lighter having a gas-valve operating pushbutton that is normally blocked against depression by means of a stop member that is slidably mounted on the lighter's upper end portion and is confined thereon between a pair of wall members that are provided at the rearward portion of the lighter's upper end portion, the stop member including a blocking member having a top surface upon which a lower surface of the pushbutton normally stands; to provide such stop member with an actuator portion thereof that projects rearwardly of the lighter's upper end portion and is connected to an inboard portion of the stop member via an interconnecting neck portion of the stop member that can slide only longitudinally and up and down within a single narrow slot that is formed by division of the wall members at the rearward end of the lighter's upper end portion; to provide such actuator inclusive of a pair of resilient arm members having free ends which are slidably engaged with outboard surfaces of such wall members, such that, when the actuator is pushed inwardly toward the slot the resilient arm members are forced to flex so as to impart a longitudinally-directed return bias to the actuator and thereby to the stop member as a whole; to provide the pushbutton defining an inner side adjacent the pushbutton's lower surface and facing away from the actuator; to provide the stop member defining an outer side adjacent the blocking member's top surface and facing in a direction toward the actuator; to provide the blocking member's top surface movable to a position longitudinally removed from the pushbutton's lower surface by corresponding inwardly directed longitudinal movement of the actuator toward the slot against a resistance produced by flexure of said resilient arm members; to provide the outer side of the blocking member then movable upwardly into a position longitudinally opposed to and in frictional contact with the pushbutton's inner side by a corresponding upward movement of the actuator toward the pushbutton, said frictional contact being then resiliently maintained by the return bias of the resilient arm members of the actuator and the blocking member being thereby held in such inward and upward position so that the pushbutton is thereby held in an unlocked condition; and to provide the pushbutton automatically returnable to its normally locked condition as a consequence of depression and release of the pushbutton, such that, depression of the pushbutton pushes the blocking member back down, and when the pushbutton is released, the blocking member is returned to its normal blocking position under the pushbutton's lower surface by the longitudinally-directed return bias of the resilient arm members.

A further object is to provide the above recited outboard surfaces of the wall members having a contour effectively defining a wedge, to provide the free ends of the resilient arm members having a given normal spaced apart relationship, to provide said wedge normally partially received between said free ends, to provide said free ends longitudinally slidable upon said wedge as a consequence of movement of the actuator inwardly toward the slot whereby said free ends are forced further apart by said wedge and are thereby biased to return to their normal spaced apart relationship, and as a result, the longitudinally-directed return bias which is imparted to the actuator is the product of a bias of the free ends to slide toward a lesser received portion of said wedge.

Another object is to provide means ensuring that the blocking member's top surface is normally correctly positioned under the pushbutton's lower surface by provision of stop means limiting longitudinal movement the stop member in response to the return bias of the resilient arm members; and to provide such stop means comprising a pair of shoulders defined on the inboard portion of the stop member on laterally opposite sides of the neck portion of the stop member and which shoulders normally abut inboard surfaces of the wall members which stand adjacent to the slot.

Another object is to provide means ensuring that when the pushbutton is depressed and then released the pushbutton's inner side will necessarily slide off the blocking member's outer side whereby the blocking member's top surface will be certain to remain depressed when the pushbutton is released and will thereby remain correctly positioned for return under the pushbutton's lower surface in response to the return bias of the resilient arm members when the pushbutton is released; and to provide such means comprising a bump formed on each of the outboard surfaces of the wall members, the bumps defining a common boundary between upper and lower areas of the outboard surfaces, the free ends of the resilient arm members being normally positioned in contact with the lower areas of such outboard surfaces and sliding upwardly onto the upper areas thereof when the actuator portion of the stop member is pushed upwardly, the bumps being designed to impede such upward sliding movement of the free ends, but only slightly, such that, the resistance effected by the bumps is hardly noticeable to the user of the lighter when the actuator is pushed upwardly by thumb, but such resistance is sufficient to overcome the adherence between the pushbutton's inner side and the blocking member's outer side that is caused by the frictional contact therebetween, and as a result, the pushbutton's inner side will necessarily slide off the blocking member's outer side and leave the blocking member's top surface at its depressed position whereby it necessarily returns to its normal blocking position under the pushbutton's lower surface in response to the return bias of the resilient arm members when the pushbutton is released.

Another object is to provide means stabilizing the up and down movement of the actuator when pushed upwardly by thumb pressure and when pushed downwardly by depression of the pushbutton; comprising, means confining a forward end of the stop member's inboard portion to the lighter's upper end portion, such that, the stop member's forward end is free to move longitudinally in response to longitudinal movement of the actuator, but when the actuator is pushed upwardly, the said forward end cannot move upwardly but is free only to pivot whereby it functions as a secured fulcrum for the actuator portion of the stop member.

Another object, in the context of a flintwheel and lever type of lighter, is to provide said stabilizing means comprising the forward end of the stop member defining a pair of rigid straight leg members which are spaced apart parallel to each other and extend longitudinally from the inboard portion of the stop member in a direction opposite from where the stop member's actuator is located, terminal ends of such leg members being confined under pivotally mounted beam member portions of such lever and being slidable longitudinally thereunder between the flint-support column and the tab members to which the beam member portions are pivotally secured, such longitudinal movement occurring when the actuator moves inwardly toward or outwardly away from the slot, but when the actuator is moved up or down, said terminal ends are free only to pivot and thereby function as the above described secured fulcrum for the actuator that stabilizes its up and down movement.

Finally, where the lighter described in the immediately preceding paragraph has its pushbutton biased to return to a given normal elevation by means including a spring that is mounted between the pushbutton and the lighter's upper end portion, a further object to provide the spacing between the above described leg members defining a stop member slot that extends between the terminal ends of the stop member's leg members and its blocking member in order to provide clearance for passage of such spring through said stop member and operating clearance for the inward and upward movements of the stop member's blocking member as above described.

DESCRIPTION OF PREFERRED EMBODIMENT

Conventional Setting For Portion Improved Upon

Figure 1:
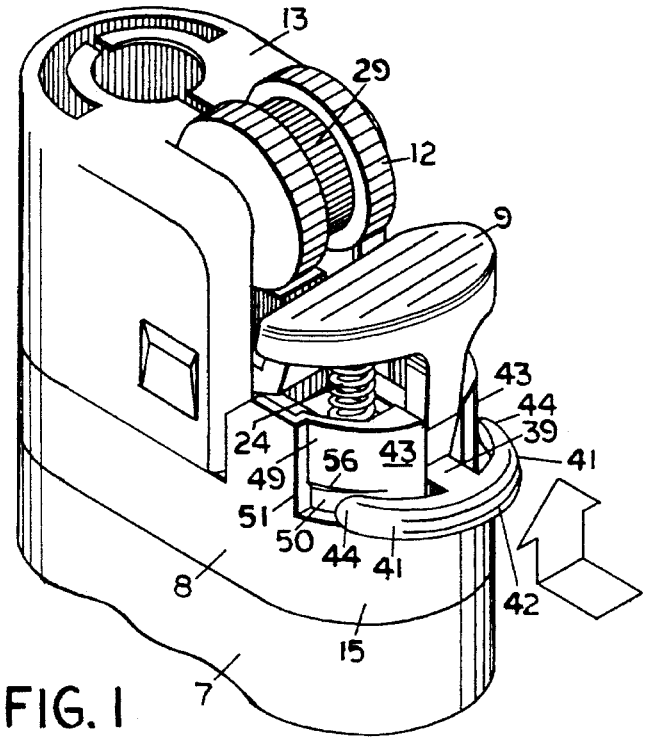
FIG. 1 is a fully assembled perspective view of a child-resistant lighter according to the invention, as seen from its rearward end, with most of the main body portion of the lighter broken away. The lighter's pushbutton is being held in a normally locked condition by means of a stop member that is mounted under the pushbutton. A lower surface of the pushbutton is in its normal position standing upon a top surface of a blocking member portion of the stop member and an actuator portion of the stop member is shown in its normal position projecting from the rearward end of the lighter's upper end portion. The arrow indicates that the pushbutton is unlocked by pushing the actuator first inwardly and then upwardly as a single continuous movement.
Figure 3:
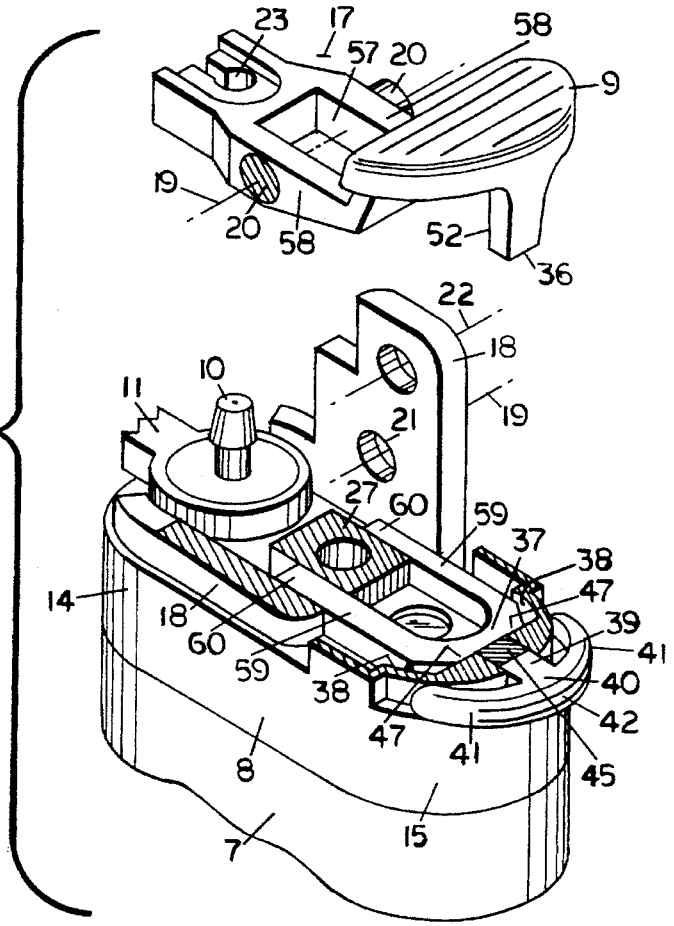
FIG. 3 is a further assembled exploded perspective view similar to FIG. 2 showing the stop member installed and the lever which defines the pushbutton positioned for installation.

Referring to FIG. 1, a disposable lighter conventionally includes a main body portion 7 (only a fragment of which is shown) defining a closed compartment for containment of a combustible fluid under pressure, an upper end portion 8 on which is mounted a pushbutton 9 that is depressible to operate a normally closed valve means 10, FIG. 3, to an open condition that releases said combustible fluid in a gaseous state, the valve means 10 typically including a flame height adjuster 11, a flintwheel 12, FIG. 1, that is rotated substantially simultaneously with depression of the pushbutton 9 to produce sparks generated by an underlying flint (not shown) that ignites the released gas to produce a flame, and a windshield 13. Although the lighter selected for illustration represents a typical construction wherein the upper end portion 8 is a distinct component that obtains a snapped-on attachment to the main body portion 7, it is to be understood that the invention is not dependent upon the upper end portion 8 being formed as a distinct component of the lighter; i.e., the upper end portion 8 could be formed in one piece with the main body portion 7.

Figure 2:
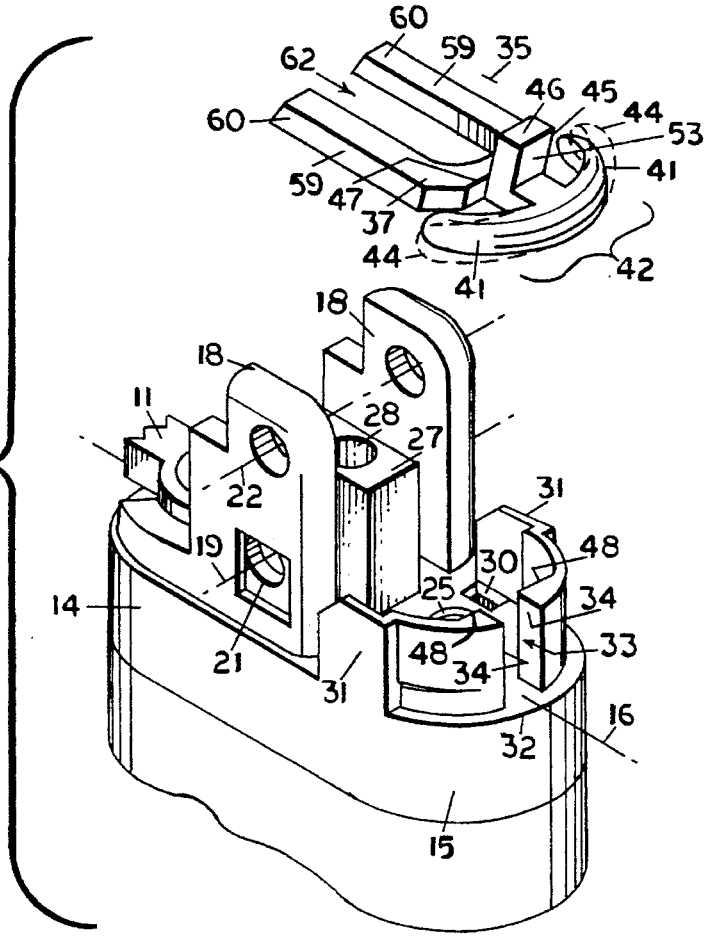
FIG. 2 is a partially disassembled exploded perspective view of the above showing the stop member positioned for installation in the upper end portion of the lighter. Dashed lines indicate the flexibility of the resilient arm members of the actuator.

Referring to FIG. 2, the upper end portion 8 has a forward portion 14 and a rearward portion 15 and shall be understood to have a longitudinal axis 16 that extends between the forward and rearward portions 14, 15, respectively. In the lighter illustrated the pushbutton 9 is defined by the rearward end of a lever indicated generally as 17 in FIG. 3. The lighter's upper end portion 8 has a pair of tabs 18, FIGS. 2 and 3, formed thereon. The lever 17 is pivotally secured to the tabs 18 for rotation about a pivot axis 19, the lever 17 being secured by means of projections 20, FIG. 3 (the nearer one being sectioned away), which project laterally from opposite sides of the lever 17 and are received in openings 21, FIGS. 2 and 3, which are provided in the tabs 18. The flintwheel 12 is similarly mounted between the tabs 18 for rotation about a second axis 22. When this lighter is fully assembled, the forward end 23, FIG. 3, of the lever 17 is engaged with the valve means 10 for lifting the valve means 10 to an open condition in response to depression of the pushbutton 9 toward the rearward portion 15 of the lighter's upper end portion 8, the valve means 10 communicating with a fuel reservoir contained in the main body portion 7 and releasing the combustible fluid in said gaseous state.

The lighter illustrated in the drawings generally reflects the styling and construction of certain well-known brands of disposable lighters but modified so as to be child-resistant according to the invention. Typically, the valve means 10 incorporates a spring (not shown) that biases the valve means 10 downwardly into a normally closed condition, and, by engagement of the forward end 23 of the lever 17 with the valve means 10, such spring simultaneously biases the pushbutton 9 to return to a given normal elevation spaced apart from the rearward portion 15 of the lighter's upper end portion 8. But in another well-known brand of disposable lighter, the pushbutton 9 is directly biased by means of a helical compression spring that is mounted directly under the pushbutton 9. In order to show applicability of the invention stop member to either type of lighter, the drawings represent a hybrid lighter wherein the pushbutton 9 is additionally biased by means of a pushbutton-biasing spring 24, FIGS. 1 and 4, that is mounted between the pushbutton 9 and the rearward portion 15 of the lighter's upper end portion 8 and functions to directly bias the pushbutton 9 to return to its normal elevation spaced apart from the rearward portion 15 of the lighter's upper end portion 8, a lower end of the pushbutton-biasing spring 24 being received in a recess 25, FIG. 2, and an upper end of the pushbutton-biasing spring 24 being received in a similar recess (not shown) which is provided in the underside of the pushbutton 9.

Conventionally, a flint-support column 27, shown in its full height in FIG. 2 and cross-sectioned to a shorter height in FIG. 3, is mounted between and spaced apart from adjacent inboard sides of the tabs 18. The flint-support column 27 has a bore 28, FIG. 2 that receives and provides support for a flint (not shown) and an underlying flint-biasing spring {not shown) that urges the flint upwardly against an abrasive periphery 29, FIG. 1, of the flintwheel 12.

The opening at 30, FIG. 2, will immediately be recognized to those skilled in the art as one of three such openings conventionally provided to facilitate the casting of bosses (not shown) on the upper end portion 8 that enables same to obtain a snapped-on attachment to an upwardly protruding portion of a plug component (not shown) the main part of which plug component is permanently cemented in and closes the upper end of the main body portion 7; a second one of such openings 30 not being shown but being similarly located on the rearward portion 15 but on the opposite side of the longitudinal axis 16 and a third one of such openings 30 not being shown but being located on the forward portion 14 under the flame height adjuster 11. The modifications comprising the invention are compatible with the current practice with respect to the location of such openings 30, and, accordingly, the invention does not require any modification of said plug component as conventionally existing. A lighter that has its upper end portion 8 formed in one piece with the main body portion 7 does not have the openings 30 or the described plug component.

Modifications Comprising The Invention

Referring to FIG. 2, the invention provides the upper end portion 8 with a pair of wall members indicated generally as 31 which are laterally spaced apart on the rearward portion 15 on opposite sides of the longitudinal axis 16, the wall members 31 converging toward each other at a rearward end 32 of the rearward portion 15 and being there separated to define a slot 33 between the wall members 31, the slot 33 being defined by opposed edges of the wall members 31, said opposed edges defining a pair of guide surfaces 34 which are spaced apart parallel to each other.

A stop member, indicated generally as 35 in FIG. 2, is mounted on the rearward portion 15 as shown in FIG. 3 and is slidable longitudinally thereon under a pushbutton lower surface 36. The stop member 35 has an inboard portion 37 that is mounted between laterally opposed inboard surfaces 38 (FIG. 3) of the wall members 31. The stop member 35 has a neck portion 39 that extends longitudinally from the inboard portion 37 through the slot 33 (FIG. 2) and has an end 40 (FIG. 3) that projects outboard of the slot 33 (FIG. 2), the neck 39 being slidable between the guide surfaces 34 and being restricted by the guide surfaces 34 to movement only longitudinally and up and down within the slot 33.

The stop member 35 (FIG. 2)includes a pair of resilient arm members 41 which extend laterally from opposite sides of the projecting end 40 (FIG. 3) of the neck 39. The projecting end 40 of the neck 39 together with portions of the resilient arm members 41 which are immediately adjacent thereto defines a thumb-pressible actuator portion 42, FIG. 2, of the stop member 35. In FIG. 2 a bracket labeled 42 identifies the whole of the area deemed to comprise the actuator portion 42; in the remaining figures such bracket is not drawn in but the numeral 42 appearing therein shall be understood to encompass the area indicated in FIG. 2.

Referring to FIG. 1, those portions of the resilient arm members 41 which are nearest the neck 39 are normally spaced apart from the outboard surfaces 43 of the wall members 31—the numeral 43 indicating such outboard surfaces 43 generally—whereby the actuator 42 is pressible inwardly toward the slot 33, FIG. 2. The resilient arm members 41 have free ends 44 which are slidably engaged with the outboard surfaces 43, and such free ends 44 have a given normally spaced apart relationship relative to each other.

In this preferred embodiment, the actuator 42 is biased to return to its normal position as shown in FIG. 1 by means of the outboard surfaces 43 being shaped so as to effectively define a wedge and by such wedge being normally partially received between the free ends 44, whereby, when the actuator 42 is pushed inwardly toward the slot 33, the free ends 44 are forced to spread further apart in the manner indicated in FIG. 2 wherein dashed lines show the outward flexibility of the free ends 44. For most attractive appearance the outboard surfaces 43 preferably have a curvature complementing that of the rearward portion 15 and such curvature has been found to produce the desired wedge-defining effect. Alternatively, the outboard surfaces 43 may be made flat and convergent toward the slot 33 in order to more positively define such wedge. When the actuator 42 is pushed inwardly toward the slot 33 (as indicated by arrow 54 in FIG. 5), the free ends 44 are forced to spread further apart in the manner indicated in FIG. 2 wherein the dashed lines show the alternate outwardly flexed position that will then be assumed by the free ends 44. The free ends 44 will then be biased to return to their normal spaced apart relationship by partial ejection of the outboard surfaces 43, and this imparts a longitudinally-directed return bias to the actuator 42 and thereby to the stop member 35 as a whole.

It will be obvious from the above that in the arrangement illustrated the longitudinally—directed return bias that is imparted to the actuator 42 is characterized by a longitudinal movement of the free ends 44 on the outboard surfaces 43.

Alternatively, the free ends 44 may be always stopped against any such longitudinal movement and such longitudinally-directed return bias obtained by forcing the resilient arm members 41 to assume a bowed configuration (not shown) when the actuator 42 is pushed inwardly toward the slot 33, and in any such alternative arrangement the outboard surfaces 43 need not have the presently preferred curvature or any other wedge defining shape; they may have any shape that is adapted to receive and positively stop longitudinal movement of the free ends 44.

Figure 5:
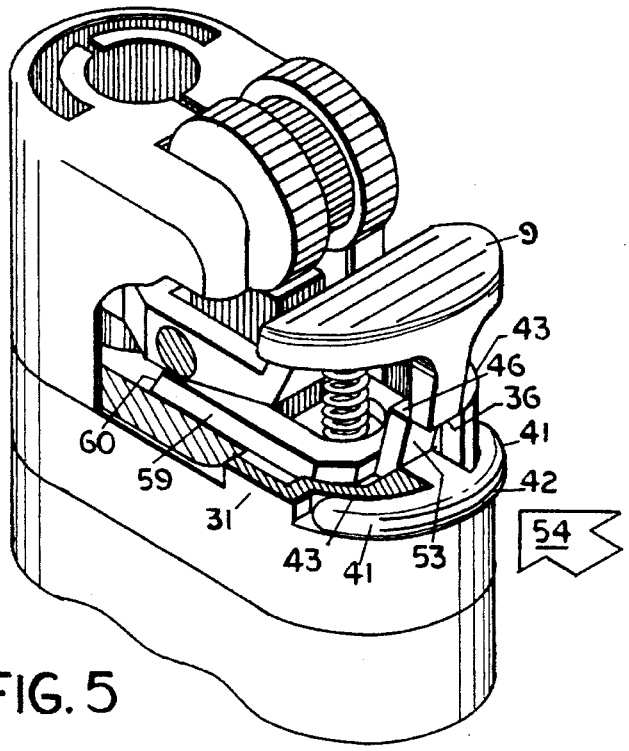
FIG. 5 is a view similar to FIG. 4 but now showing the actuator pushed inwardly as indicated by the adjacent arrow whereby the blocking member's top surface has been moved to a position longitudinally removed from the pushbutton's cooperating lower surface.
Figure 6:
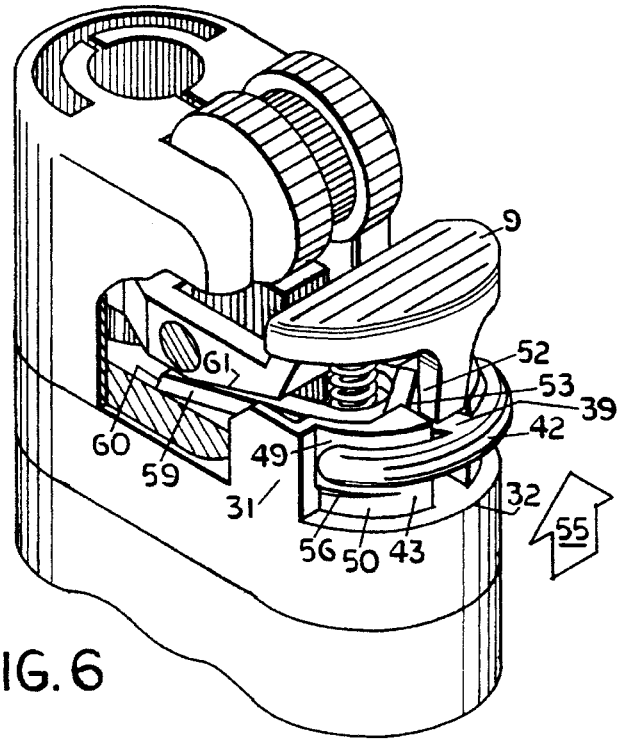
FIG. 6 is a view similar to FIG. 5 in that the actuator is still in its inwardly moved position, but now showing the actuator also pushed upwardly as indicated by the adjacent arrow whereby an outer side of the blocking member has been moved into a position longitudinally opposed to and in frictional contact with an inner side of the pushbutton whereby the pushbutton is held in an unlocked condition.

The illustrated arrangement is preferred because it permits the resilient arm members 41 to have a substantial thickness due to the effectiveness of the "wedge" in forcing the free ends 44 further apart, such thickness being contemplated to facilitate moldability of the resilient arm members 41; the resilient arm members 41 being thereby as ruggedly constructed as the remainder of the stop member 35, and the stop member 35 being thereby ejectable from the molding die without damage and lending itself to handling by machine without breakage. Another advantage of the preferred arrangement is that it enables a substantial longitudinal movement of the actuator 42 without having to press the actuator 42 very hard-the free ends 44 being easy to force further apart by pushing further upon the outboard surfaces 43. Still another advantage is that when the actuator 42 is pushed inwardly, the resilient arm members 41 tend to flatten out against the outboard surfaces 43 as shown in FIGS. 5 and 6 (as opposed to bowing outwardly away from same) and thereby no aesthetically displeasing outward projection of the resilient arm members 41 occurs.

Figure 4:
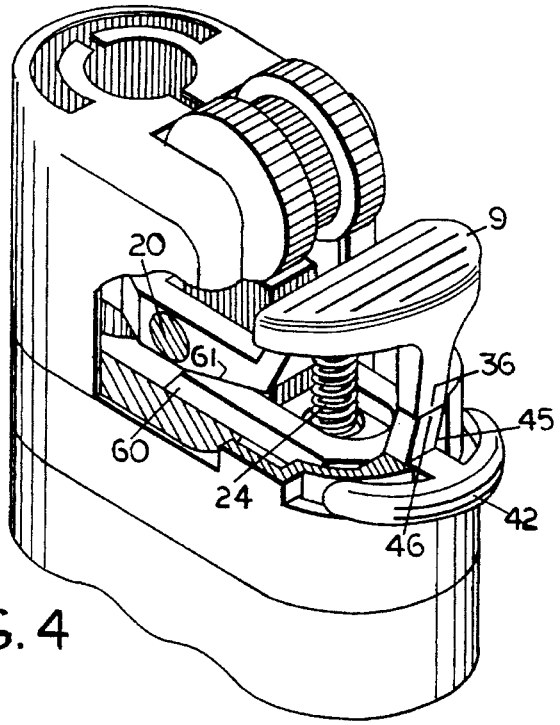
FIG. 4 is a fully assembled perspective view similar to FIG. 1 but partly broken away to show the terminal ends of leg members which define a forward end of the stop member, the said terminal ends being shown in a normal position under the pivotally mounted beam member portions of the lever, and the actuator being shown in its normal position.

Referring to FIG. 2, the stop member 35 has a portion thereof located at least near but preferably on the neck 39 which defines a blocking member indicated generally as 45. The blocking member 45 has a top surface 46 that is normally opposed to the pushbutton's lower surface 36 (FIG. 3) so as to normally block depression of the pushbutton 9, the pushbutton's lower surface 36 normally standing upon the blocking member's top surface 46 as shown in FIGS. 1 and 4 whereby the pushbutton 9 is normally maintained in a locked condition.

A stop means is provided to limit longitudinal movement of the stop member 35 in response to the return bias of the actuator 42 in order to ensure that the blocking member's top surface 46 will normally be positively located under the pushbutton's lower surface 36, and also to ensure that the free ends 44 are normally pressed against the outboard surfaces 43 (as opposed to being loosely positioned near same). In this preferred embodiment such stop means comprises a pair of shoulders 47, FIG. 3, which are formed on the inboard portion 37 of the stop member 35 and which shoulders 47 normally abut inboard walls 48 of the wall members 31 that stand adjacent to the guide surfaces 34, such inboard walls 48 being identified in FIG. 2 and the manner of their normal abutment with the shoulders 47 being shown in FIG. 3. In FIG. 3 the blocking member 45 has been sectioned away in order to reveal shoulder 47 that would otherwise be obscured by the blocking member 45.

Referring again to FIG. 1, each of the outboard surfaces 43 has an upper area 49 and a lower area 50 which are hereinafter referred to as though both outboard surfaces 43 were fully visible in the drawings. The free ends 44 of the resilient arm members 41 are normally located on the lower areas 50 of the outboard surfaces 43; the free ends 44 sliding upwardly onto the upper areas 49 when the actuator 42 is pushed upwardly toward the pushbutton 9, and sliding downwardly onto the lower areas 50 again when the pushbutton 9 is depressed. The upper and lower areas 49, 50, respectively, are preferably recessed, as indicated by the setback 51, whereby the free ends 44 of the resilient arm members 41 are enabled to lie substantially flush with the sides of the lighter body; the recess begun by the setback 51 preferably being continued to the rearward end 32 (FIG. 2) whereby the rearward projection of the actuator 42 is also minimized for best appearance and most compact proportions.

Referring to FIG. 3, the pushbutton 9 defines an inner side 52 that has a corner in common with the pushbutton's lower surface 36 and faces in a direction toward the lever's pivot axis 19, so that, when the lever 17 is installed in the lighter, such inner side 52 will then face in a direction toward the forward portion 14 of the lighter's upper end portion 8.

The blocking member 45, FIG. 2, defines an outer side 53 that has a corner in common with the blocking member's top surface 46 and faces in a direction toward the actuator 42.

Referring to FIG. 5, pushing the actuator 42 inwardly toward the slot 33 (FIG. 2) as indicated by arrow 54, moves the blocking member's top surface 46 into a position longitudinally inwardly removed from the pushbutton's lower surface 36. This defines a clearance under the pushbutton's lower surface 36 that is deep enough to permit depression of the pushbutton 9 far enough that the valve means 10 (FIG. 3) will be operated to its gas-releasing open condition. If the actuator 42 were to be released at this time, the blocking member's top surface 46 would promptly return under the pushbutton's lower surface 36 in response to the return bias of the actuator 42.

Holding the actuator 42 pushed inwardly as indicated by arrow 54 in FIG. 5 and simultaneously pushing the actuator 42 upwardly toward the pushbutton 9 as indicated by arrow 55 in FIG. 6, moves the blocking member's outer side 53 upwardly toward the pushbutton 9 into a position longitudinally opposed to and in slidable frictional contact with the pushbutton's inner side 52. The clearance previously referred to is then produced under the stop member 35 as is evident in FIG. 6 wherein the actuator 42 is seen lifted well above the rearward end 32. Accordingly, in FIG. 6 the pushbutton 9 is shown in an unlocked condition that is being maintained by a frictional contact between the blocking member's outer side 53 and the pushbutton's inner side 52 that is being resiliently maintained by the return bias of the actuator 42, the resilient arm members 41 of which are now substantially flattened against the upper areas 49 of the outboard surfaces 43. The user can now let go of the actuator 42 but the pushbutton 9 will remain in its unlocked condition until the pushbutton 9 is depressed and then released.

When the pushbutton 9 is depressed (by pivotal movement about the axis 19, FIG. 3), the pushbutton's lower surface 36 (FIG. 5) pushes the neck 39 (FIG. 6) downwardly far enough to return the blocking member's top surface 46 to the position in which it is seen in FIG. 5; i.e., correctly positioned for return under the pushbutton's lower surface 36 as shown in FIG. 4. When the pushbutton 9 is released, the pushbutton-biasing means which is effective upon the pushbutton 9 returns the pushbutton's lower surface 36 to its normal elevation and the return bias of the actuator 42 then returns the blocking member's top surface 46 to its normal position under the pushbutton's lower surface 36 as shown in FIG. 4 (and also in FIG. 1), whereby the pushbutton 9 is automatically returned to its normally locked condition.

Accordingly, FIGS. 4, 5 and 6 show a complete cycle of operation except that the pushbutton 9 is not shown in the depressed position; FIG. 4 showing the actuator 42 in its initial position with the blocking member 45 having its top surface 46 positioned underlying the pushbutton's lower surface 36 whereby the pushbutton 9 is normally blocked against depression; FIG. 5 showing the actuator 42 pushed inwardly whereby the blocking member's top surface 46 has been moved into a position longitudinally removed from the pushbutton's lower surface 36; and FIG. 6 showing the actuator 42 pushed upwardly whereby the blocking member's outer side 53 has been moved into a position longitudinally opposed to and in a resiliently maintained frictional engagement with the inner side 52 of the pushbutton 9 whereby the pushbutton 9 is held in an unlocked condition. Obviously, when the pushbutton 9 is depressed and release, the actuator 42 and the blocking member 45 will return to their respective initial positions as shown in FIG. 4, and as shown also in FIG. 1.

The invention provides a means of impeding upward movement of the blocking member's outer side 53 with the pushbutton's inner side 52 due to the adherence therebetween that will be caused by the said resiliently maintained frictional contact so that the pushbutton's inner side 52 will necessarily slide off the blocking member's outer side 53 when the pushbutton 9 is released after having been depressed. In the illustrated embodiment, the said means impeding comprises a bump 56, FIG. 1, that is formed on each of the outboard surfaces 43 between the upper area 49 and the lower area .50. It being understood that there are two such bumps 56 they are hereinafter referred to in the plural as though both outboard surfaces 43 were fully visible.

As previously stated, the free ends 44 of the resilient arm members 41 are normally positioned in contact with the lower areas 50 of the outboard surfaces 43 and slide upwardly onto the upper areas 49 when the actuator 42 is pushed upwardly. The bumps 56 are designed to impede such upward movement of the free ends 44, but only slightly, such that, the resistance effected by the bumps 56 is hardly noticeable to the user of the lighter when the actuator 42 is pushed upwardly by thumb, but such resistance is sufficient to overcome the adherence between the pushbutton's inner side 52 and the blocking member's outer side 53 that is caused by the resiliently maintained frictional contact therebetween, and as a result, the pushbutton's inner side 52 necessarily slides off the blocking member's outer side 53 and leaves the blocking member's top surface 46 at its depressed position, whereby, the moment the pushbutton's lower surface 36 returns to its normal elevation the blocking member's top surface 46 will return to its normal blocking position in response to the return bias of the actuator 42.

The invention further provides a means of stabilizing the up and down movement of the actuator 42 comprising means confining a forward end of the stop member's inboard portion 37, FIGS. 2 and 3, to the lighter's upper end portion 8, such that, said forward end is free to move longitudinally in response to longitudinal movement of the actuator 42, but, when the actuator 42 is pushed upwardly, the said forward end of the inboard portion 37 cannot move upwardly but is free only to pivot whereby it functions as a secured fulcrum for the actuator 42. Conventionally, the lever 17, FIG. 3, has a central opening 57 which is provided to permit the flint (not shown) that is carried by the flint-support column 27 to access the abrasive periphery 29 (FIG. 1)of the flintwheel 12. The central opening 57 (FIG. 3) defines a pair of beam member portions 58 of the lever 17 which extend longitudinally of the upper end portion 8 between the flint-support column 27 and the adjacent inboard sides of the tabs 18. Conventionally, the beam member portions 58 are pivotally mounted at an elevation on the tabs 18 and as a result of such elevated mounting a space conventionally exists under the beam member portions 58; i.e., between same and the upper end portion 8. In the preferred embodiment of the stop member 35, FIG. 2, the forward end of the stop member 35 defines a pair of rigid straight leg members 59, which are spaced apart parallel to each other and extend longitudinally from the inboard portion 37 in a direction opposite from where the actuator 42 is located; the leg members 59 having terminal ends 60 which preferably are mounted, as shown in FIG. 3, in the above-described spaces conventionally existing under the beam member portions 58 between the flint-support column 27 and the tabs 18 which stops the terminal ends 60 against any lateral movement but permits longitudinal movement of the terminal ends 60 and thereby the stop member 35 as a whole in response to corresponding longitudinal movements of the actuator 42. When the lever 17 is installed, its beam member portions 58 prevent the terminal ends 60 from being lifted upwardly away from the upper end portion 8, the beam member portions 58 confining the terminal ends 60 with operating clearance therebetween such that they are free to move longitudinally in response to longitudinal movement of the actuator 42 but can move only pivotally in response to up and down movement of the actuator 42; the leg members 59 of course being proportioned flat enough to provide such operating clearance between the beam member portions 58 and the leg members 59 that such longitudinal movement of the leg members 59 is permitted, and the undersides of the beam member portions 58 being inclined as indicated at 61 in FIGS. 4 and 6, to provide an operating clearance that permits the terminal ends 60 of the leg members 59 to pivot as shown in FIG. 6.

Alternatively, the terminal ends 60 can be provided with lateral projections (such as those identified as 20 which are conventionally provided on the lever 17) whereby the terminal ends 60 can be pivotally secured either to the tabs 18, or to the flint-support column 27, or, by making the leg members 59 shorter, the terminal ends 60 can be pivotally secured to the inboard surfaces of the wall members 31 nearest the tabs 18. In any such alternative arrangement, the said lateral projections would be received in openings that are elongated to permit longitudinal as well as pivotal movement of the terminal ends 60.

The drawings illustrate the simplest arrangement, wherein the terminal ends 60 are confined by the beam member portions 58 with the described operating clearances therebetween; FIG. 4 showing the terminal end 60 normally located directly under the lever's lateral projection 20 when the actuator 42 is located in its normal position; FIG. 5 showing the terminal end 60 in a longitudinally moved position relative to the projection 20 when the actuator 42 has been pushed inwardly; and FIG. 6 showing the terminal end 60 in a pivoted position when the actuator 42 has been pushed upwardly.

Referring again to FIG. 2, the spacing between the leg members 59 conveniently defines a stop member slot 62. Where, as in the present instance, the pushbutton 9 is biased by means of a pushbutton-biasing spring 24 that is mounted between the pushbutton 9 and the rearward portion 15, the stop member slot 62 extends from the terminal ends 60 substantially all the way to the blocking member 45 and thereby provides clearance for passage of the pushbutton-biasing spring 24 through the stop member 35, the stop member slot 62 providing a sufficient lateral clearance between the inboard portion 37 of the stop member 35 and the pushbutton-biasing spring 24 for uninhibited operation of the pushbutton-biasing spring 24, and also providing a sufficient longitudinal clearance between the blocking member 45 and the pushbutton-biasing spring 24 so that the blocking member 45 can be moved inwardly and upwardly as described without interference with the pushbutton-biasing spring 24.

Still referring to FIG. 2, the blocking member's outer side 53 is preferably inclined inwardly relative to the top surface 46 in order that when the blocking member 45 is in its lifted position as shown in FIG. 6, only the corner where the blocking member's outer side 53 and top surface 46 intersect will be in contact with the pushbutton's inner side 52, and this ensures a positive but easily slidable frictional contact minimizing adherence therebetween.

Note in FIG. 2 that the abutment face of the shoulder 47 is inwardly inclined like the blocking member's outer side 53, and that the free ends 44 of the resilient arm members 41 are rounded. During installation of the stop member 35, the wall members 31 of the upper end portion 8 are received between the shoulders 47 and the free ends 44. The inclination of the shoulders 47 enables them to function like wedges that enable the wall members 31 to be positively received between the shoulders 47 and the free ends 44, whereby the resilient arm members 41 are residually tensioned and as a result the free ends 44 are maintained positively pressed against the outboard surfaces 43. This ensures positive contact between the free ends 44 and the lower areas 50 of the outboard surfaces 43 so that the bumps 56 will necessarily be effective in preventing upward movement of the blocking member 45 with the pushbutton's inner side 52 when the pushbutton 9 is released after having been depressed. The inclination of the shoulders 47 also serves to facilitate molding that area of the stop member 35 by enabling the pertinent portion of the molding die to have a desirably thick cross-section for ruggedness sufficient to withstand molding pressures.

I claim:

1. A child-resistant lighter, including:

a main body portion defining a closed compartment for containment of a combustible fluid under pressure and an upper end portion having a forward portion and a rearward portion; said lighter having a longitudinal axis extending across said forward and rearward portions of said upper end portion so as to include and intersect said forward and rearward portions of said upper end portion;

valve means mounted on said upper end portion at the forward portion thereof communicating with said compartment for release of said fluid in a gaseous state, said valve means being normally in a closed condition that prevents release of said fluid from said compartment and being operable to an open condition that releases said fluid from said compartment in said gaseous state;

means mounted on said upper end portion defining...a depressible pushbutton having a lower surface that is positioned opposed to and normally spaced apart from said rearward portion, said pushbutton lower surface being depressible toward said rearward portion by depression of said pushbutton;

means engaging said pushbutton with said valve means for operation of said valve means to said open condition in response to depression of said pushbutton lower surface toward said rearward portion by depression of said pushbutton;

means biasing said pushbutton to return said pushbutton lower surface to said position normally spaced apart from said rearward portion after depression and release of said pushbutton; and, means operable substantially simultaneously with depression of said pushbutton producing a spark for igniting said fluid;

wherein the improvement comprises:

a pair of wall members laterally spaced apart on said rearward portion of said upper end portion on opposite sides of said longitudinal axis, said wall members converging toward each other at a rearward end of said rearward portion with opposed edges of said wall members spaced apart from each other to define a slot between said wall members, said opposed edges defining a pair of guide surfaces which are spaced apart parallel to each other on opposite sides of said longitudinal axis;

a stop member slidably mounted on said rearward portion under said pushbutton lower surface for movement axially of said longitudinal axis, said stop member having an inboard portion positioned and slidable between inboard surfaces of said wall members and a neck portion extending longitudinally from said inboard portion through and beyond said slot so that an end portion of said neck portion projects outboard of said rearward portion, said neck portion being slidable between said guide surfaces and being restricted by said guide surfaces to movement longitudinally within said slot and to movement upwardly and downwardly toward and away from said pushbutton lower surface, respectively;

said stop member including a pair of resilient arm members extending laterally from opposite sides of said projecting end portion of said neck portion, said projecting end portion of said neck portion together with portions of said resilient arm members which are immediately adjacent to said projecting end portion defining a thumb-pressible actuator portion of said stop member, said resilient arm members being normally spaced apart from outboard surfaces of said wall members to permit pressing said actuator portion inwardly toward said slot but said resilient arm members having free ends which are in contact with said outboard surfaces of said wall members;

means cooperatively engaging said free ends of said resilient arm members with said outboard surfaces of said wall members such that when said actuator portion is pushed inwardly toward said slot said resilient arm members are forced to flex and as a result of such flexure said resilient arm members impart a longitudinally-directed return bias to said actuator portion that functions to return said resilient arm members to said position normally spaced apart from said outboard surfaces of said wall members;

said stop member having a portion thereof located near said neck portion defining a blocking member having a top surface, said pushbutton lower surface normally standing upon said blocking member top surface, stop means limiting longitudinal movement of said stop member in response to said return bias of said actuator portion such that said blocking member top surface normally underlies said pushbutton lower surface and said pushbutton is thereby normally blocked against depression whereby said pushbutton is normally maintained in a locked condition;

each of said outboard surfaces of said wall members having an upper area and a lower area, said free ends of said resilient arm members being normally positioned on the lower areas of said outboard surfaces, said free ends sliding upwardly toward said pushbutton onto the upper areas of said outboard surfaces when said actuator portion is pushed upwardly toward said pushbutton, and said free ends sliding downwardly toward said rearward portion back onto the lower areas of said outboard surfaces again when said actuator portion is caused to move downwardly toward said rearward portion;

said pushbutton defining an inner side facing in a direction toward the forward portion of said upper end portion and having a corner in common with said pushbutton lower surface;

said blocking member defining an outer side facing in a direction toward said actuator portion and having a corner in common with said blocking member top surface;

by movement of said actuator portion longitudinally inwardly toward said slot, said blocking member top surface being moved against the resistance of said return bias of said actuator portion to a position correspondingly longitudinally inwardly removed from said pushbutton lower surface;

by movement of said actuator portion upwardly toward said pushbutton while simultaneously maintaining said blocking member top surface longitudinally inwardly removed from said pushbutton lower surface, said blocking member outer side being moved upwardly toward said pushbutton into a position longitudinally opposed to and in slidable frictional contact with said pushbutton inner side, said movement of said actuator portion upwardly toward said pushbutton defining a clearance between said neck portion of said stop member and said rearward portion that is sufficient for depression of said pushbutton lower surface toward said rearward portion for operation of said valve means to said open condition, said pushbutton being then in an unlocked condition, said frictional contact being resiliently maintained by said return bias of said actuator portion and as a consequence thereof said actuator portion being releasable and said pushbutton remaining in said unlocked condition;

upon depression of said pushbutton a portion of said pushbutton impacting a portion of said stop member so as to push said neck portion of said stop member downwardly against said rearward portion, said blocking member top surface being thereby positioned for re-entry under said pushbutton lower surface;

means impeding upward movement of said blocking member outer side with said pushbutton inner side due to adherence therebetween caused by said frictional contact, said means impeding functioning to ensure that said pushbutton inner side necessarily slides off said blocking member outer side when said pushbutton is released after having been depressed and as a result said blocking member top surface remains positioned for re-entry under said pushbutton lower surface when said pushbutton is released after having been depressed;

upon release of said pushbutton said means biasing said pushbutton returning said pushbutton lower surface to said position normally spaced apart from said rearward portion, and simultaneously, said return bias of said actuator portion effecting re-entry of said blocking member top surface under said pushbutton lower surface whereby said pushbutton lower surface is again blocked against depression and said pushbutton is thereby automatically returned to said normally locked condition.

2. A child-resistant lighter as in claim 1 wherein said outboard surfaces of said wall members have a contour effectively defining a wedge, the free ends of said resilient arm members have a given normal spaced apart relationship, said wedge is normally partially received between said free ends, said free ends are longitudinally slidable on said wedge as a consequence of movement of said actuator portion inwardly toward said slot and said free ends are thereby forced further apart by said wedge and are then biased to return to said normal spaced apart relationship, said return bias of said actuator being the result of a bias of said free ends to return to their normal spaced apart relationship by sliding toward a lesser received portion of said wedge.

3. A child-resistant lighter as in claim 1 wherein the free ends of said resilient arm members have a given normal spaced apart relationship such that said free ends are always pressed against said outboard surfaces of said wall members, and said means impeding comprises means defined on at least one of said outboard surfaces between said upper area and said lower area of said at least one outboard surface functioning to impede slidability of the free end of the resilient arm member that is engaged with said at least one outboard surface from said lower area to said upper area of said at least one outboard surface with a resistance great enough that said adherence between said pushbutton inner side and said blocking member outer side cannot enable said pushbutton inner side to pull said blocking member outer side with said pushbutton inner side when said pushbutton is released after having been depressed, but a sufficient force applied to said actuator portion when pushing it upwardly toward said pushbutton does enable said last-recited free end to override said means impeding and slide upwardly toward said pushbutton from said lower area to said upper area of said at least one outboard surface.

4. A child-resistant lighter as in claim 3 wherein said means functioning to impede slidability comprises a bump formed on said at least one outboard surface between the upper and lower areas of said at least one outboard surface.

5. A child-resistant lighter as in claim 1 including means confining a forward end of said inboard portion of said stop member to said upper end portion of said lighter such that said forward end of said inboard portion is free to slide longitudinally in response to movement of said actuator portion inwardly toward said slot but said forward end of said inboard portion is free only to pivot in response to movement of said actuator portion upwardly toward said pushbutton so that said forward end of said inboard portion then functions as a secured fulcrum about which said actuator portion pivots when said actuator portion is moved upwardly toward said pushbutton by thumb pressure applied to said actuator portion and when said actuator portion is moved downwardly toward said rearward portion by depression of said pushbutton.

6. A child-resistant lighter as in claim 1 wherein said stop means limiting longitudinal movement of said stop member in response to said return bias of said actuator portion comprises a pair of shoulders defined on said inboard portion on laterally opposite sides of said neck portion and which normally abut segments of said inboard surfaces of said wall members which stand adjacent to said slot.

7. A child-resistant lighter as in claim 1 wherein said upper and lower areas of said outboard surfaces of said wall members comprise segments of said outboard surfaces which are recessed relative to unrecessed segments of said outboard surfaces which lie adjacent to said recessed segments of said outboard surfaces, and said free ends of said resilient arm members are received in the recessed lower areas of said outboard surfaces substantially flush with said adjacent unrecessed segments of said outboard surfaces.

8. A child-resistant lighter, including:

a main body portion defining a closed compartment for containment of a combustible fluid under pressure and an upper end portion having a forward portion and a rearward portion;

said lighter having a longitudinal axis extending across said forward and rearward portions of said upper end portion so as to include and intersect said forward and rearward portions of said upper end portion;

valve means mounted on said upper end portion at the forward portion thereof communicating with said compartment for release of said fluid in a gaseous state, said valve means being normally in a closed condition that prevents release of said fluid from said compartment and being operable to an open condition that releases said fluid from said compartment in said gaseous state;

a pair of tab members mounted on said upper end portion between said forward and rearward portions, said tab members being spaced apart parallel to each other on opposite sides of said longitudinal axis;

a lever member extending longitudinally of said upper end portion between said tab members, said lever member having a central opening defining a pair of beam member portions of said lever member which are pivotally secured to said tab members at an elevation on same spaced apart from said upper end portion for rotation about a pivot axis perpendicular to said longitudinal axis, said lever member having a portion thereof on a rearward side of said pivot axis defining a depressible pushbutton having a lower surface that is positioned opposed to and normally spaced apart from said rearward portion, said pushbutton lower surface being depressible toward said rearward portion by depression of said pushbutton, said lever member having a portion thereof on a forward side of said pivot axis engaged with said valve means for operation of said valve means to said open condition in response to depression of said pushbutton lower surface toward said rearward portion by depression of said pushbutton;

means biasing said pushbutton to return said pushbutton lower surface to said position normally spaced apart from said rearward portion after depression and release of said pushbutton; and, a flintwheel rotatably mounted between said tab members overlying said beam member portions of said lever member for rotation about an axis parallel to said pivot axis;

a flint-support column mounted on said upper end portion between said tab members and extending through said central opening and having an upper end proximate an abrasive periphery of said flintwheel, opposite sides of said column being spaced apart from adjacent inboard sides of said tab members, said beam member portions of said lever member being positioned between said opposite sides of said column and said inboard sides of said tab members, said column being provided with a bore, a flint and a flint-biasing spring mounted in said bore with said flint-biasing spring underlying and urging said flint into contact with said abrasive periphery for production of sparks generated by said flint upon rotation of said flintwheel substantially simultaneously with depression of said pushbutton for ignition of said fluid;

wherein the improvement comprises:

a pair of wall members laterally spaced apart on said rearward portion of said upper end portion on opposite sides of said longitudinal axis, said wall members converging toward each other at a rearward end of said rearward portion with opposed edges of said wall members spaced apart from each other to define a slot between said wall members, said opposed edges defining a pair of guide surfaces which are spaced apart parallel to each other on opposite sides of said longitudinal axis;

a stop member slidably mounted on said rearward portion under said pushbutton lower surface for movement axially of said longitudinal axis, said stop member having an inboard portion positioned and slidable between inboard surfaces of said wall members and a neck portion extending longitudinally from said inboard portion through and beyond said slot so that an end portion of said neck portion projects outboard of said rearward portion, said neck portion being slidable between said guide surfaces and being restricted by said guide surfaces to movement longitudinally within said slot and to movement upwardly and downwardly toward and away from said pushbutton lower surface, respectively;

said stop member including a pair of resilient arm members extending laterally from opposite sides of said projecting end portion of said neck portion, said projecting end portion of said neck portion together with portions of said resilient arm members which are immediately adjacent to said projecting end portion defining a thumb-pressible actuator portion of said stop member, said resilient arm members being normally spaced apart from outboard surfaces of said wall members to permit pressing said actuator portion inwardly toward said slot but said resilient arm members having free ends which are in contact with said outboard surfaces of said wall members;

means cooperatively engaging said free ends of said resilient arm members with said outboard surfaces of said wall members such that when said actuator portion is pushed inwardly toward said slot said resilient arm members are forced to flex and as a result of such flexure said resilient arm members impart a longitudinally-directed return bias to said actuator portion that functions to return said resilient arm members to said position normally spaced apart from said outboard surfaces of said wall members;

said stop member having a portion thereof located near said neck portion defining a blocking member having a top surface, said pushbutton lower surface normally standing upon said blocking member top surface, stop means limiting longitudinal movement of said stop member in response to said return bias of said actuator portion such that said blocking member top surface normally underlies said pushbutton lower surface and said pushbutton is thereby normally blocked against depression whereby said pushbutton is normally maintained in a locked condition;

each of said outboard surfaces of said wall members having an upper area and a lower area, said free ends of said resilient arm members being normally positioned on the lower areas of said outboard surfaces, said free ends sliding upwardly toward said pushbutton onto the upper areas of said outboard surfaces when said actuator portion is pushed upwardly toward said pushbutton, and said free ends sliding downwardly toward said rearward portion back onto the lower areas of said outboard surfaces again when said actuator portion is caused to move downwardly toward said rearward portion;

said pushbutton defining an inner side facing in a direction toward the forward portion of said upper end portion and having a corner in common with said pushbutton lower surface;

said blocking member defining an outer side facing in a direction toward said actuator portion and having a corner in common with said blocking member top surface;

by movement of said actuator portion longitudinally inwardly toward said slot, said blocking member top surface being moved against the resistance of said return bias of said actuator portion to a position correspondingly longitudinally inwardly removed from said pushbutton lower surface;

by movement of said actuator portion upwardly toward said pushbutton while simultaneously maintaining said blocking member top surface longitudinally inwardly removed from said pushbutton lower surface, said blocking member outer side being moved upwardly toward said pushbutton into a position longitudinally opposed to and in slidable frictional contact with said pushbutton inner side, said movement of said actuator portion upwardly toward said pushbutton defining a clearance between said neck portion of said stop member and said rearward portion that is sufficient for depression of said pushbutton lower surface toward said rearward portion for operation of said valve means to said open condition, said pushbutton being then in an unlocked condition, said frictional contact being resiliently maintained by said return bias of said actuator portion and as a consequence thereof said actuator portion being releasable and said pushbutton remaining in said unlocked condition;

upon depression of said pushbutton a portion of said pushbutton impacting a portion of said stop member so as to push said neck portion of said stop member downwardly against said rearward portion, said blocking member top surface being thereby positioned for re-entry under said pushbutton lower surface;

means impeding upward movement of said blocking member outer side with said pushbutton inner side due to adherence therebetween caused by said frictional contact, said means impeding functioning to ensure that said pushbutton inner side necessarily slides off said blocking member outer side when said pushbutton is released after having been depressed and as a result said blocking member top surface remains positioned for re-entry under said pushbutton lower surface when said pushbutton is released after having been depressed;

upon release of said pushbutton said means biasing said pushbutton returning said pushbutton lower surface to said position normally spaced apart from said rearward portion, and simultaneously, said return bias of said actuator portion effecting re-entry of said blocking member top surface under said pushbutton lower surface whereby said pushbutton lower surface is again blocked against depression and said pushbutton is thereby automatically returned to said normally locked condition.

9. A child-resistant lighter as in claim 8 wherein said outboard surfaces of said wall members have a contour effectively defining a wedge, the free ends of said resilient arm members have a given normal spaced apart relationship, said wedge is normally partially received between said free ends, said free ends are longitudinally slidable on said wedge as a consequence of movement of said actuator portion inwardly toward said slot and said free ends are thereby forced further apart by said wedge and are then biased to return to said normal spaced apart relationship, said return bias of said actuator being the result of a bias of said free ends to return to their normal spaced apart relationship by sliding toward a lesser received portion of said wedge.

10. A child-resistant lighter as in claim 8 wherein the free ends of said resilient arm members have a given normal spaced apart relationship such that said free ends are always pressed against said outboard surfaces of said wall members, and said means impeding comprises means defined on said outboard surfaces between said upper areas and said lower areas of said outboard surfaces functioning to impede slidability of the free ends of said resilient arm members from said lower areas to said upper areas of said outboard surfaces with a resistance great enough that said adherence between said pushbutton inner side and said blocking member outer side cannot enable said pushbutton inner side to pull said blocking member outer side with said pushbutton inner side when said pushbutton is released after having been depressed, but a sufficient force applied to said actuator portion when pushing it upwardly toward said pushbutton does enable said free ends to override said means impeding and slide upwardly toward said pushbutton from said lower areas to said upper areas of said outboard surfaces.

11. A child-resistant lighter as in claim 10 wherein said means functioning to impede slidability comprises a bump formed on each of said outboard surfaces between said upper and lower areas of said outboard surfaces.

12. A child-resistant lighter as in claim 8 wherein said stop means limiting longitudinal movement of said stop member in response to the return bias of said actuator portion comprises a pair of shoulders defined on said inboard portion of said stop member at laterally opposite sides of said neck portion and which normally abut segments of said inboard surfaces of said wall members which segments stand adjacent to said slot.

13. A child-resistant lighter as in claim 12 wherein said forward end defines a pair of rigid straight leg members which are spaced apart parallel to each other and have terminal ends which are mounted between said flint support column and said tab members and are adapted to slide longitudinally of said upper end portion under said beam member portions of said lever member, and said means confining confines said terminal ends such that said terminal ends are free to slide longitudinally when said actuator portion is pushed inwardly toward said slot but said terminal ends are free only to pivot when said actuator portion is pushed upwardly toward said pushbutton and said terminal ends thereby function as said secured fulcrum for said actuator portion.

14. A child-resistant lighter as in claim 13 wherein said means confining said terminal ends comprises said beam member portions of said lever member.

15. A child-resistant lighter as in claim 13 wherein said means biasing said pushbutton includes a pushbutton-biasing spring mounted between said pushbutton and said rearward portion of said upper end portion, said leg members define a stop member slot between said leg members that extends from said terminal ends to said blocking member, said pushbutton-biasing spring stands within said stop member slot and said stop member slot provides operating clearance for said pushbutton-biasing spring and operating clearance for said blocking member to be moved without interference with said pushbutton-biasing spring when said blocking member outer side is moved into said position longitudinally opposed to and in slidable frictional contact with said pushbutton inner side.

16. A child-resistant lighter as in claim 8 including means confining a forward end of said inboard portion of said stop member to said upper end portion of said lighter such that said forward end of said inboard portion is free to slide longitudinally in response to movement of said actuator portion inwardly toward said slot but said forward end of said inboard portion is free only to pivot in response to movement of said actuator portion upwardly toward said pushbutton so that said forward end of said inboard portion then functions as a secured fulcrum about which said actuator portion pivots when said actuator portion is moved upwardly toward said pushbutton by thumb pressure applied to said actuator portion and when said actuator portion is moved downwardly toward said rearward portion by depression of said pushbutton.

17. A child-resistant lighter as in claim 8 wherein said upper and lower areas of said outboard surfaces of said wall members comprise segments of said outboard surfaces which are recessed relative to unrecessed segments of said outboard surfaces which lie adjacent to said recessed segments of said outboard surfaces, and said free ends of said resilient arm members are received in the recessed lower areas of said outboard surfaces substantially flush with said adjacent unrecessed segments of said outboard surfaces.

18. A child-resistant lighter, including:

a main body portion defining a closed compartment for containment of a combustible fluid under pressure and an upper end portion having a forward portion and a rearward portion; said lighter having a longitudinal axis extending across said forward and rearward portions of said upper end portion so as to include and intersect said forward and rearward portions of said upper end portion;

valve means mounted on said upper end portion at the forward portion thereof communicating with said compartment for release of said fluid in a gaseous state, said valve means being normally in a closed condition that prevents release of said fluid from said compartment and being operable to an open condition that releases said fluid from said compartment in said gaseous state;

means mounted on said upper end portion defining a depressible pushbutton having a lower surface that is positioned opposed to and normally spaced apart from said rearward portion, said pushbutton lower surface being depressible toward said rearward portion by depression of said pushbutton;

means engaging said pushbutton with said valve means for operation of said valve means to said open condition in response to depression of said pushbutton lower surface toward said rearward portion by depression of said pushbutton;

means biasing said pushbutton to return said pushbutton lower surface to said position normally spaced apart from said rearward portion after depression and release of said pushbutton; and, means operable substantially simultaneously with depression of said pushbutton producing a spark for igniting said fluid;

wherein the improvement comprises:

a pair of wall members laterally spaced apart on said rearward portion of said upper end portion on opposite sides of said longitudinal axis, said wall members converging toward each other at a rearward end of said rearward portion with opposed edges of said wall members spaced apart from each other to define a slot between said wall members, said opposed edges defining a pair of guide surfaces which are spaced apart parallel to each other on opposite sides of said longitudinal axis;

a stop member slidably mounted on said rearward portion under said pushbutton lower surface for movement axially of said longitudinal axis, said stop member having an inboard portion positioned and slidable between inboard surfaces of said wall members and a neck portion extending longitudinally from said inboard portion through and beyond said slot so that an end portion of said neck portion projects outboard of said rearward portion, said neck portion being slidable between said guide surfaces and being restricted by said guide surfaces to movement longitudinally within said slot and to movement upwardly and downwardly toward and away from said pushbutton lower surface, respectively;

said stop member including a pair of resilient arm members extending laterally from opposite sides of said projecting end portion of said neck portion, said projecting end portion of said neck portion together with portions of said resilient arm members which are immediately adjacent to said projecting end portion defining a thumb-pressible actuator portion of said stop member, said resilient arm members being normally spaced apart from outboard surfaces of said wall members to permit pressing said actuator portion inwardly toward said slot but said resilient arm members having free ends which are in contact with said outboard surfaces of said wall members;

said outboard surfaces having a contour effectively defining a wedge, said free ends of said resilient arm members having a given normal spaced apart relationship and being slidably engaged with said outboard surfaces such that said free ends are always pressed against said outboard surfaces, said outboard surfaces being normally partially received between said free ends, said free ends being longitudinally slidable on said wedge as a consequence of movement of said actuator portion inwardly toward said slot and said free ends being thereby forced to spread further apart by said wedge, the spreading of said free ends being enabled by flexure of said resilient arm members, said free ends being then biased to return to said normal spaced apart relationship by sliding toward a lesser received portion of said wedge and thereby imparting a longitudinally-directed return bias to said actuator portion;

said stop member having a portion thereof located near said neck portion defining a blocking member having a top surface, said pushbutton lower surface normally standing upon said blocking member top surface, stop means limiting longitudinal movement of said stop member in response to said return bias of said actuator portion such that said blocking member top surface normally underlies said pushbutton lower surface and said pushbutton is thereby normally blocked against depression whereby said pushbutton is normally maintained in a locked condition, said stop means comprising a pair of shoulders defined on said inboard portion on laterally opposite sides of said neck portion and which normally abut segments of said inboard surfaces of said wall members which stand adjacent to said slot;

said pushbutton defining an inner side facing in a direction toward the forward portion of said upper end portion and having a corner in common with said pushbutton lower surface;

said blocking member defining an outer side facing in a direction toward said actuator portion and having a corner in common with said blocking member top surface;

by movement of said actuator portion longitudinally inwardly toward said slot, said blocking member top surface being moved against the resistance of said return bias of said actuator portion to a position correspondingly longitudinally inwardly removed from said pushbutton lower surface;

by movement of said actuator portion upwardly toward said pushbutton while simultaneously maintaining said blocking member top surface longitudinally inwardly removed from said pushbutton lower surface, said blocking member outer side being moved upwardly toward said pushbutton into a position longitudinally opposed to and in slidable frictional contact with said pushbutton inner side, said movement of said actuator portion upwardly toward said pushbutton defining a clearance between said neck portion of said stop member and said rearward portion that is sufficient for depression of said pushbutton lower surface toward said rearward portion for operation of said valve means to said open condition, said pushbutton being then in an unlocked condition, said frictional contact being resiliently maintained by said return bias of said actuator portion and as a consequence thereof said actuator portion being releasable and said pushbutton remaining in said unlocked condition;

upon depression of said pushbutton a portion of said pushbutton impacting a portion of said stop member so as to push said neck portion of said stop member downwardly against said rearward portion, said blocking member top surface being thereby positioned for re-entry under said pushbutton lower surface;

means impeding upward movement of said blocking member outer side with said pushbutton inner side due to adherence therebetween caused by said frictional contact, said means impeding functioning to ensure that said pushbutton inner side necessarily slides off said blocking member outer side when said pushbutton is released after having been depressed and as a result said blocking member top surface remains positioned for re-entry under said pushbutton lower surface when said pushbutton is released after having been depressed, said means impeding comprising, a bump formed on each of said outboard surfaces of said wall members between said upper and lower areas of said outboard surfaces, said bumps functioning to impede slidability of the free ends of said resilient arm members from said lower areas to said upper areas of said outboard surfaces with a resistance great enough that said adherence cannot enable said pushbutton inner side to pull said blocking member outer side with said pushbutton inner side when said pushbutton is released after having been depressed, but a sufficient force applied to said actuator portion when pushing said actuator portion upwardly toward said pushbutton does enable said free ends to override said bumps and slide upwardly toward said pushbutton from said lower areas to said upper areas of said outboard surfaces;

upon release of said pushbutton said means biasing said pushbutton returning said pushbutton lower surface to said position normally spaced apart from said rearward portion, and simultaneously, said return bias of said actuator portion effecting re-entry of said blocking member top surface under said pushbutton lower surface whereby said pushbutton lower surface is again blocked against depression and said pushbutton is thereby automatically returned to said normally locked condition.

19. A child-resistant lighter as in claim 18 including means confining a forward end of said inboard portion of said stop member to said upper end portion of said lighter such that said forward end of said inboard portion is free to slide longitudinally in response to movement of said actuator portion inwardly toward said slot but said forward end of said inboard portion is free only to pivot in response to movement of said actuator portion upwardly toward said pushbutton so that said forward end of said inboard:portion then functions as a secured fulcrum about which said actuator portion pivots when said actuator portion is moved upwardly toward said pushbutton by thumb pressure applied to said actuator portion and when said actuator portion is moved downwardly toward said rearward portion by depression of said pushbutton.

20. A child-resistant lighter as in claim 19 including:

a pair of tab members mounted on said upper end portion between said forward and rearward portions, said tab members being spaced apart parallel to each other on opposite sides of said longitudinal axis;

said means defining a depressible pushbutton comprising a lever member that extends longitudinally of said upper end portion between said tab members, said lever member having a central opening defining a pair of beam member portions of said lever member which are pivotally secured to said tab members at an elevation on same spaced apart from said upper end portion for rotation about a pivot axis perpendicular to said longitudinal axis, a portion of said lever member on a rearward side of said pivot axis defining said depressible pushbutton having said lower surface, and a portion of said lever on a forward side of said pivot axis being engaged with said valve means for operation of said valve means to said open condition in response to depression of said pushbutton;

said means for igniting said fluid comprising a flintwheel rotatably mounted between said tab members overlying said beam member portions of said lever member for rotation about an axis parallel to said pivot axis, a flint-support column mounted on said upper end portion between said tab members and extending through said central opening and having an upper end proximate an abrasive periphery of said flintwheel, opposite sides of said column being spaced apart from adjacent inboard sides of said tab members, said beam member portions of said lever member being positioned between said opposite sides of said column and said inboard sides of said tab members, said column being provided with a bore, a flint and flint-biasing spring mounted in said bore with said flint-biasing spring underlying and urging said flint into contact with said abrasive periphery for productions of sparks generated by said flint upon rotation of said flintwheel substantially simultaneously with depression of said pushbutton for ignition of said fluid;

said forward end of said stop member defining a pair of rigid straight leg members which are spaced apart parallel to each other and have terminal ends which are mounted between said column and said tab members so as to be slidable longitudinally of said upper end portion under said beam member portions of said lever member when said actuator portion is pushed inwardly toward said slot, said beam member portions confining said terminal ends such that said terminal ends are free only to pivot when said actuator portion is pushed upwardly toward said pushbutton and said terminal ends thereby function as said secured fulcrum for said actuator portion.

21. A child-resistant lighter as in claim 20 wherein said means biasing said pushbutton includes a pushbutton-biasing spring mounted between said pushbutton and said rearward portion of said upper end portion, said leg members define a stop member slot between said leg members that extends from said terminal ends to said blocking member, said pushbutton-biasing spring stands within said stop member slot and said stop member slot provides operating clearance for said pushbutton-biasing spring and operating clearance for said blocking member to be moved without interference with said pushbutton-biasing spring when said blocking member outer side is moved into said position longitudinally opposed to and in slidable frictional contact with said pushbutton inner side.

22. A child-resistant lighter as in claim 21 wherein said upper and lower areas of said outboard surfaces of said wall members comprise segments of said outboard surfaces which are recessed relative to unrecessed segments of said outboard surfaces which lie adjacent to said recessed segments of said outboard surfaces, and said free ends of said resilient arm members are received in the recessed lower areas of said outboard surfaces substantially flush with said adjacent unrecessed segments of said outboard surfaces.

* * * * *